US005796321A

United States Patent [19]

Caillat et al.

[11] Patent Number: 5,796,321

[45] Date of Patent: Aug. 18, 1998

[54] SELF-SUPPORTED APPARATUS FOR THE PROPAGATION OF ULTRAHIGH FREQUENCY WAVES

[75] Inventors: Patrice Caillat, Echirolles; Claude Massit, Saint-Ismier, both of France

[73] Assignee: Commissariat a l'Energie Atomique, Paris, France

[21] Appl. No.: 689,044

[22] Filed: Jul. 30, 1996

[30] Foreign Application Priority Data

Aug. 31, 1995 [FR] France ..... 95 10261

[51] Int. Cl.[6] ..... H01P 5/00

[52] U.S. Cl. ..... 333/246; 257/777; 257/782; 333/247

[58] Field of Search ..... 333/246, 247; 343/700 MS; 257/777, 782, 783

[56] References Cited

U.S. PATENT DOCUMENTS

| | | | |
|---|---|---|---|
| 3,577,037 | 5/1971 | Di Pietro et al. | 257/777 X |
| 4,131,894 | 12/1978 | Schiavone | 333/246 X |
| 4,849,722 | 7/1989 | Cruchon et al. | 333/246 X |
| 4,929,999 | 5/1990 | Hoeberechts et al. | 257/782 |

OTHER PUBLICATIONS

IEEE Antennas and Propagation Magazine, vol. 35, No. 5, pp. 9–17, Oct. 1993, L. P. B. Katehi, et al., "Micromachined Circuits for Millimeter–and Sub–Millimeter–Wave Applications".

Applied Physics Letters, vol. 57, No. 11, pp. 1123–1125, Sep. 10, 1990, D.R. Dykaar, et al., "Ultrafast Coplanar Air–Transmission Lines".

Proceedings of the IEEE, vol. 80, No. 11, pp. 1748–1770, Nov. 1992, Gabriel M. Rebeiz, "Millimeter–Wave and Terahertz Integrated Circuit Antennas".

*Primary Examiner*—Paul Gensler

*Attorney, Agent, or Firm*—Oblon, Spivak, McClelland, Maier & Neustadt, P.C.

[57] ABSTRACT

An apparatus for the propagation of microwaves, particularly ultrahigh frequency waves. A substrate has formed therein a cavity open on one of the sides of the substrate. A membrane is deposited on the substrate above the cavity. At least one transmission line is located on the membrane which is able to propagate an ultrahigh frequency wave. An integrated circuit for rigidifying the membrane is fixed to the transmission line or to the membrane on the side where the line is located.

27 Claims, 4 Drawing Sheets

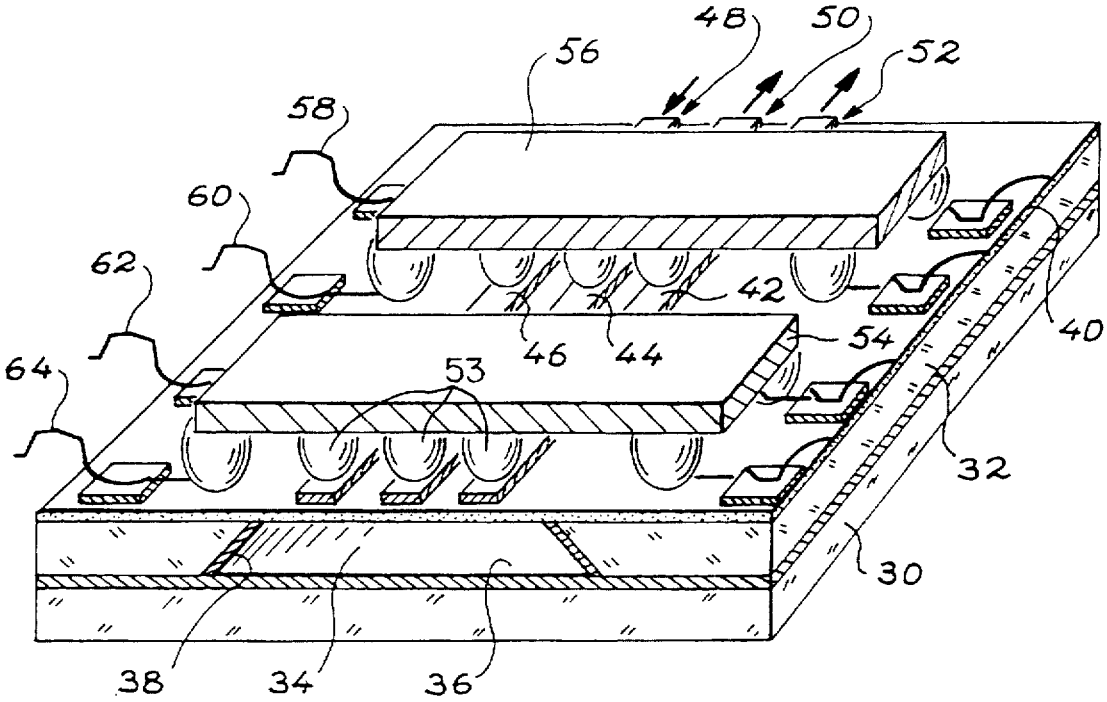
FIG. 2
FIG. 3A
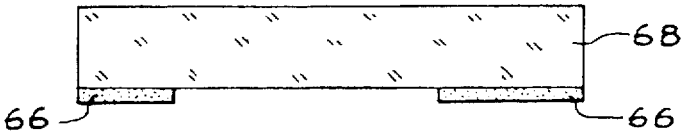
FIG. 3B
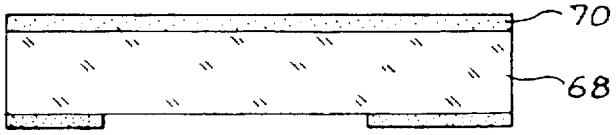

SELF-SUPPORTED APPARATUS FOR THE PROPAGATION OF ULTRAHIGH FREQUENCY WAVES

TECHNICAL FIELD

The invention relates to an apparatus for the propagation of ultrahigh frequency waves. Such an apparatus is more particularly used in micro-electronics, where there is an increasing need for apparatuses with very high electric wave propagation speeds, particularly as a result of advances in technologies on GaAs or other fast semiconductors, which make it possible to implement frequencies of approximately 1 gigahertz. The applications can also relate to the field of antennas directly integrated on silicon, where the frequencies can reach 1 terahertz.

The critical point for all these technologies is the transport of the high frequency signal (also called microwave) from the antenna to a processing circuit, or between two fast integrated circuits, said transport having to take place with the minimum possible deterioration or negative changes. The causes of deteriorations are in particular stray couplings between lines, dispersions by emission or losses due to active loads. In order to combat these losses, it is necessary to adapt the electric lines, by reducing their electrical resistance and improving the quality of the dielectrics used in the interline insulations.

PRIOR ART

For some years now developments have taken place in connection with structures on-silicon having electric lines adapted to very high frequencies. Such a structure is described in the article by L. P. B. KATEHI entitled "Michromachined circuit for millimeter-and sub-millimeter-wave Applications" published in IEEE Antennas and Propagation Magazine, vol. 35, No. 5, pp 9 to 17, October 1993. In said apparatus, air is used as the dielectric and a micromachined silicon substrate is used as an electrical shielding cavity.

More specifically, such an apparatus is illustrated in FIG. 1A, where references 2 and 4 designate high resistivity silicon substrates. The substrate 4 is machined in such a way as to open there a cavity 6, which issues onto the upper face of the substrate. On the side of said upper face, said cavity is closed by a membrane 8 formed from $SiO_2$—$Si_3N_4$—$SiO_2$ layers. Said membrane serves as a barrier layer during the etching of the cavity 6. Said etching is e.g. a KOH etching. On the cavity walls is deposited a CrAu shielding layer 10, 12. A microwave line 14 able to propagate ultrahigh frequency waves is deposited on the membrane 8. The membrane is in general as thin as possible so as to be transparent to ultrahigh frequency signals. It has a thickness of approximately 1 micro-meter and is at the maximum a few micrometers. In such a configuration, the electric field is confined between the line 14 and the metallized walls of the cavity 6. This leads to a high propagation speed and to low dispersion and dielectric losses.

FIG. 1B, where reference numerals identical to those of FIG. 1A designate the same elements, shows a variant. A silicon cover 16 is joined to the front face of the apparatus. Said cover also has a cavity 18, whose walls have a metallization 20, 22. Thus, there is a complete shielding of the two sides of the membrane and the microwave line.

In both cases, the microwave line benefits from the presence of the cavity 6 in order to avoid any stray coupling with other conductors. The cavity is entirely connected to earth, which provides an effective shielding.

In such a structure, in order to be effective, the maximum thickness of the membrane is a few micrometers. Such membranes can be produced by depositing oxide-nitride-oxide layers. Such a composition avoids any stresses within the membrane, which would lead to its destruction on release, i.e. during the etching of the substrate 4 to produce the cavity 6.

At present it is only possible to produce membranes on moderately large surfaces which are limited in width to a few millimeters. Thus, it is already very difficult to obtain a membrane with the dimensions 20 mm×3 mm. Alternatively it is possible to use a polyimide membrane which, by its very nature, is in principle less fragile. However, the membrane obtained remains fragile because it is suspended, above the cavity, over a large surface.

In general terms, no solution exists making it possible to produce a membrane which is sufficiently thin to be transparent to waves and which at the same time is sufficiently resistant, particularly to shocks and vibrations during the use of the component. This applies to an ever greater extent as the surface of the membrane increases in size.

Another problem arises when it is wished to integrate high frequency, active integrated circuits with the aforementioned structure type. An example of such an integration is shown in fig. IC, where identical references to those of FIG. 1A designate the same elements. An integrated circuit 24 is connected to the line 14 by means of assembly wires, which introduce a limitation with respect to the propagation rate of high frequency signals.

DESCRIPTION OF THE INVENTION

Therefore the present invention aims at proposing an apparatus for the propagation of microwaves, particularly ultrahigh frequency waves, as well as its production process, in which the thin membrane still has a certain resistance to shocks and vibrations when the apparatus is in use. Moreover, when said apparatus is combined with a high frequency active circuit, the connection between the propagation apparatus and the active circuit has a very limited influence on the propagation of the waves.

More specifically, the invention relates to an apparatus for the propagation of microwaves, particularly ultrahigh frequency waves, comprising a substrate in which is formed a cavity open on one of the sides of the substrate, a membrane, deposited on the substrate, above the cavity, at least one transmission line located on the membrane and able to propagate an ultrahigh frequency wave and means for rigidifying the membrane, fixed to at least the line and/or the membrane, on the side where the line is located. The cavity can be shielded.

The means for rigidifying the membrane can incorporate at least one active circuit, e.g. an integrated circuit. It can be fixed by conductor elements, e.g. metal microspheres. A connection by means of spheres has excellent electrical properties and in particular a low capacitance, low resistivity, ultrashort connection length and in particular a very limited influence on the part of the integrated circuit on the microwave conductor lines.

The means for rigidifying the membrane can alternately have a passive substrate, e.g. an insulating substrate or chip, connected to the line and/or to the membrane by insulating anchoring elements, e.g. by bonding polymer anchoring means or plastic spheres to the membrane and/or transmission line.

Advantageously, the means for rigidifying the membrane are also fixed to the substrate (which may or may not be covered by the membrane) by means of anchoring elements, which can be conductive or insulating, in a zone located beyond the opening defined by the cavity on one of the substrate sides.

The latter feature ensures a better mechanical strength of the assembly.

The invention also relates to a process for producing an apparatus for the propagation of microwaves comprising a stage of depositing a membrane on a substrate, a stage of micromachining the substrate in order to free a cavity beneath the membrane, a stage of forming on said membrane at least one transmission line able to propagate an ultrahigh frequency wave, said stage following or preceding the micromachining stage and a stage of fixing to the line and/or membrane, on the side where the line is formed, means for rigidifying the membrane.

The fixing stage can take place after the micromachining stage. However, the size of the cavity is then somewhat limited, because there is still a risk of the membrane breaking manipulations taking place prior to the hybridization of the means for rigidifying the membrane.

Thus, advantageously the fixing stage is performed before the micromachining stage. In this case, there is no longer a cavity size limitation, the membrane having been freed following the production of the rigidification means or reinforcements.

BRIEF DESCRIPTION OF THE DRAWINGS

The invention is described in greater detail hereinafter relative to non-limitative embodiments and with reference to the attached drawings, wherein show:

FIG. 2 The production of an ultrahigh frequency wave propagation apparatus according to the invention.

FIGS. 3A to 3G The stages of a process for producing an apparatus according to the invention.

DETAILED DESCRIPTION OF EMBODIMENTS OF THE INVENTION

Figure 1A:
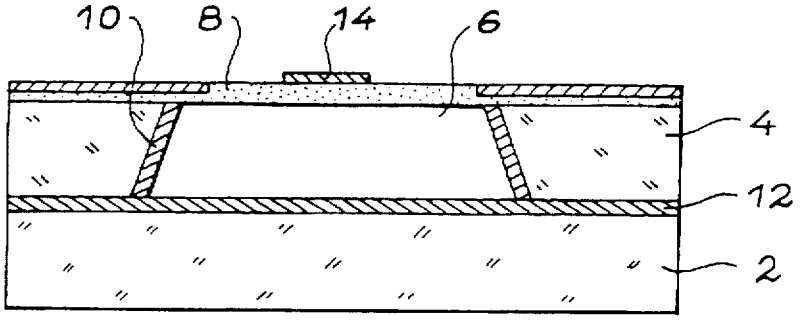
FIG. 1A PRIOR ART
FIGS. 1A, 1B & 1C Prior art embodiments.
Figure 1B:
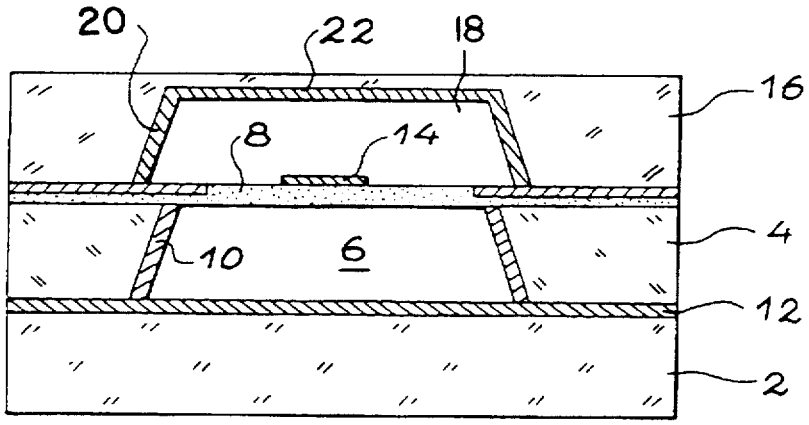
FIG. 1B PRIOR ART
Figure 1C:
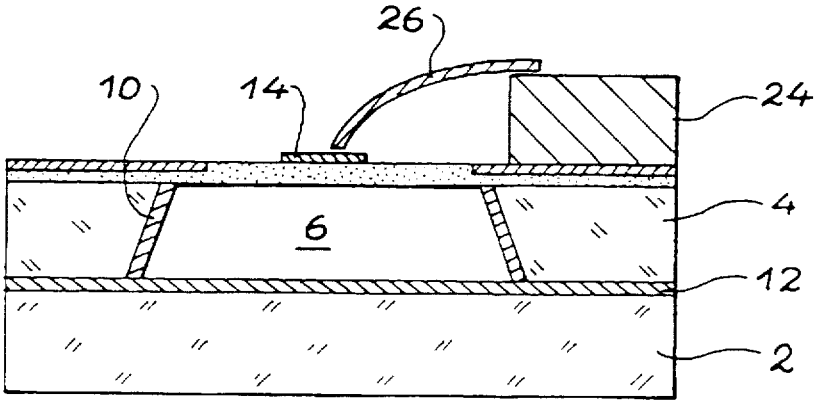
FIG. 1C PRIOR ART

FIG. 2 shows in perspective an apparatus according to the invention. This apparatus firstly has a structure, which is similar to that described hereinbefore in conjunction with FIG. 1A. This structure has a substrate 30 on which is deposited a layer 32 (or second substrate), said substrate and said layer being preferably of silicon. The layer 32 is machined or micromachined and consequently has a cavity 34, whose walls 36, 38 can be metallized, e.g. with the aid of a CrAu deposit forming a shielding.

A membrane 40 is deposited on the edge 32 above the cavity 36 and consequently closes the latter on one side. This membrane can be an organic or mineral membrane with a thickness of a few micrometers. The thickness is adapted in such a way that the membrane is transparent at least to ultrahigh frequency signals for the wavelength range used.

On the membrane are deposited e.g. three lines 42, 44, 46 suitable for ultrahigh frequency wave propagation. These lines are connected to an ultrahigh frequency apparatus, e.g. by means of an input 48 and two outputs 50, 52. These lines e.g. have a thickness of 1 to 20 μm and a width of 20 to 2000 μm.

According to the invention, two integrated circuits 54, 56 are hybridized, on the side of the membrane on which are formed the lines 42, 44, 46. Hybridization takes place with the aid of interconnection conductive micro-spheres 53, which provide a connection between each of the circuits and the transmission lines of the membrane 40. Each of the integrated circuits is connected to other elements, not shown in the drawing, by means of low frequency inputs-outputs 58, 60, 62, 64.

In the apparatus shown in FIG. 2, it is the integrated circuits 54, 56 which permit the rigidification of the membrane 40. An ultrahigh frequency connection is also established between the two integrated circuits by means of connection microspheres and transmission lines 42, 44, 46. The integrated circuits are hybridized above the cavity 34, which ensures that the membrane has a good mechanical strength.

FIG. 2 shows three transmission lines and two integrated circuits. It is clear that the invention is not limited to this number of lines, but instead relates to an apparatus having a random number of lines (1, 2, 4 or more) and a random number of circuits (the reinforcement effect obtained by the hybridized circuit being obtained even in the case of a single circuit at the location where the latter is hybridized).

Moreover, the reinforcement effect is also obtained if hybridization takes place, not to an integrated circuit, but to a random substrate, e.g. a passive insulating substrate or a silicon chip. Said hybridization can take place by bonding with the aid of polymer anchoring elements or with the aid of spheres or microspheres, e.g. plastic spheres, bonded to the membrane and/or to the ultrahigh frequency transmission lines. Such a circuit can be produced if no chip or active circuit is required by-the apparatus, e.g. in the case of integrated antennas.

Consequently, in general terms, in the structure according to the invention, there is a reinforcement or an aid to the mechanical strength of the membrane, which supports the microwave lines. It is therefore possible to produce free membrane surfaces (i.e. passing above a micromachined cavity) of much larger size than in the case of the known structures and in particular having a greater resistance to shocks, mechanical vibrations and heat shocks.

The structure of FIG. 2 shows that if there is a need for producing a microwave connection between integrated circuits, the integrated circuit-microwave line connection advantageously takes place by means of inter-connection conductive microspheres. The latter have excellent electrical properties, namely low capacitance, low resistivity and an ultrashort connection length. There is also a very limited influence of the integrated circuit on the conductive microwave lines. Thus, there is always an air gap between a circuit, such as the circuit 54, and the membrane 40, due to the presence of the microspheres. This makes it possible to eliminate coupling effects with respect to the fitting by wires. Moreover, the possibility of hybridizing a circuit on the membrane, while retaining an air gap, i.e. without prejudicing the performance characteristics of the ultrahigh frequency lines, is a clear advantage for maximum integration.

Process for producing an apparatus according to the invention will now be described.

Figure 3C:
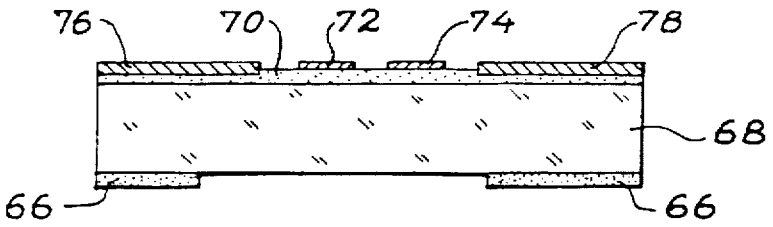
Figure 3D:
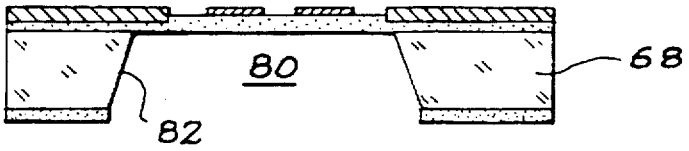
Figure 3E:
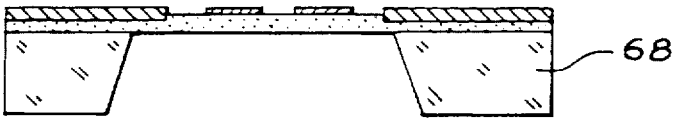
Figure 3F:
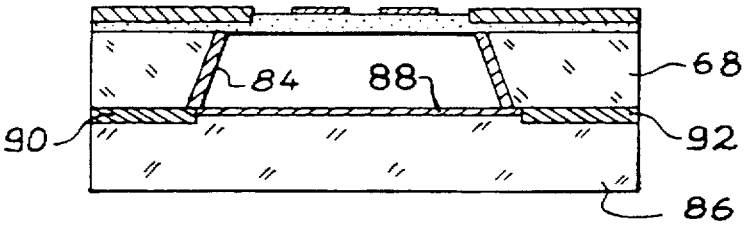
Figure 3G:
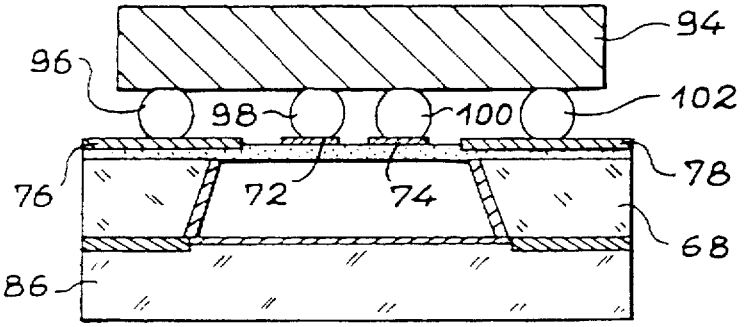

A first process is described in conjunction with FIGS. 3A to 3G. In a first stage (FIG. 3A), a lithography mask 66 is positioned on the rear face of a substrate 68, e.g. a silicon substrate. A membrane 70 is then deposited on the front face of said substrate (FIG. 3B). This membrane can be a composite $SiO_2$—$Si_3N_4$—$SiO_2$ membrane obtained e.g. by thermal oxidation and CVD. Lines 72, 74 for ultrahigh frequency wave propagation, as well as possibly lateral connections 76, 78 can then be formed on the membrane 70, e.g. by masking and metallic sputtering (FIG. 3C). A cavity 80 can then be etched or micromachined in the substrate 68 from the rear face of the latter, e.g. by KOi etching, the masking element 66 making it possible to define the etching zone and making it possible to open a cavity. In this example, t h e etching define s a cavity, whose side walls 82 con tract from the front face (FIG. 3D). After eliminating the masking element 66 (FIG. 3E) by etching the rear face of the substrate 68, a shielding 84 of the side walls 82 of the cavity 80 can be implemented, e.g. by CrAu deposition by sputtering (FIG. 3F). Moreover, a cover 86, which is also of silicon and which also has a metallized surface 88, is welded to the substrate 68. References 90, 92 designate the welding zones between the cover 86 and the substrate 68, which are e.g. produced by meltable metal soldering or the thermometallic compression of metals. In the plane of FIG. 3F, the cavity 80 is then completely closed on three sides by a metallization 84, 88 and on one side by the membrane 70. Finally (FIG. 3G), an integrated circuit 94 is hybridized on the lines 72, 74 and on the connections 76, 78 with the aid of microspheres 96, 98, 100, 102. The connection takes place by standard solder reflow hybridization, the chip or more specifically the stiffener is placed by means of meltable microspheres above the membrane and welding or soldering preferably takes place at high temperature, without pressure application, which gives rise to no stresses on the membrane.

Thus, it is possible to obtain an apparatus according to the invention with the aid of a process compatible with the procedures used in microelectronics, which permits collective production. The succession of stages described hereinbefore in conjunction with FIGS. 3A to 3G still causes a problem, namely it somewhat limits the size of the cavity 80, because there is still a risk of the membrane 70 breaking during the manipulations prior to the hybridization of the reinforcing element 94.

Figure 4A:
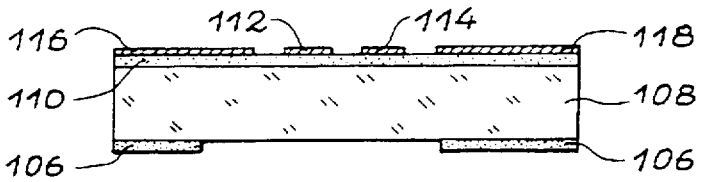
FIGS. 4A to 4E The stages of another process for producing an apparatus according to the invention.
Figure 4B:
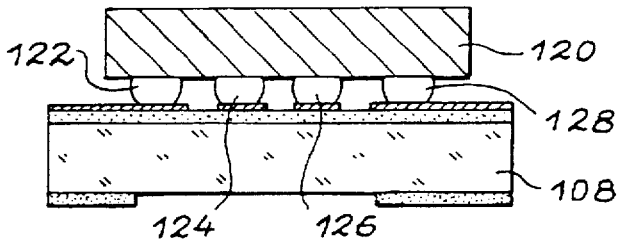
Figure 4C:
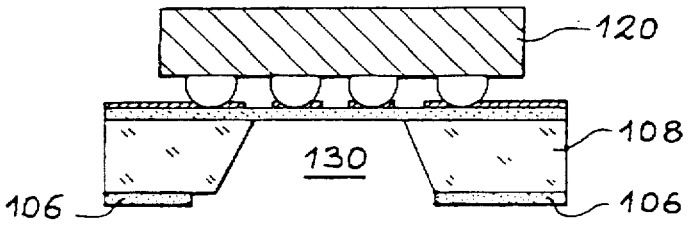
Figure 4D:
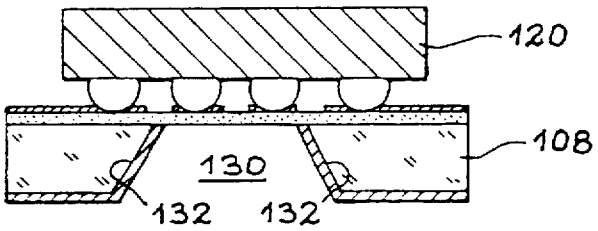
Figure 4E:
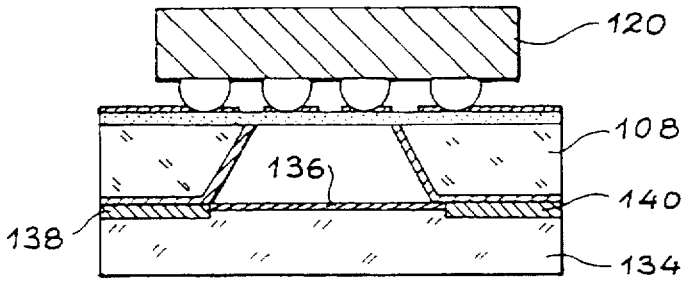

In order t o obviate this disadvantage, another process is proposed and this will now be described in conjunction with FIGS. 4A to 4E. In this process, as hereinbefore, there is firstly a masking 106 of a substrate 108, followed by the deposition of a membrane 110 and the formation of lines 112, 114f or the transmission of ultrahigh frequency waves, as well as, optionally, the formation of lateral connections 116, 118 (FIG. 4A). This is followed by the immediate hybridization of the reinforcing element 120, e.g. with the aid of microspheres 122, 124, 126, 128. The membrane 110 can then be freed by micromachining or etching from the rear face of the substrate 108, e.g. by KOH etching. This gives a cavity 130 (FIG. 4C). The rear face of the substrate 108 is then etched so as to eliminate the masking elements 106. A metallization is then deposited on the side walls 132 of the cavity 130 (FIG. 4D). Finally, the junction is formed with a cover 134 having a metallization 136, the references 138, 140 designating the welding zones between the substrate 108 and the cover 134 (FIG. 4E).

This second process firstly makes it possible to produce the mechanical reinforcement required by the membrane, prior to the release of the latter by etching from the substrate and the formation of the cavity.

The two aforementioned processes permit the hybridization of a circuit 94, 120 by microspheres 96–102 and 122–128. However, these two processes can also be applied to a random reinforcing element, e.g. a passive or insulating substrate, the connection with the membrane 70, 110 preferably taking place with the aid of polymer anchoring elements or microspheres, which are e.g. made from plastic and which are bonded.

We claim:

1. Apparatus for the propagation of ultrahigh frequency microwaves, comprising a substrate in which is formed a cavity open on one of the sides of the substrate, an insulating membrane deposited on the substrate and above the cavity, at least one transmission line located on the membrane above the cavity for propagating said ultrahigh frequency microwaves, and means for rigidifying the membrane, said means being fixed to the membrane on a lateral side from where the transmission line is located and fixed to at least that part of the membrane situated above the cavity.

2. Apparatus for the propagation of microwaves according to claim 1, the cavity being an electrically shielded cavity.

3. Apparatus for the propagation of microwaves according to either of the claim 1 and 2, the means for rigidifying the membrane having at least one active circuit.

4. Apparatus according to claim 3, said at least one active circuit being connected to the membrane by conductive elements.

5. Apparatus according to claim 4, the conductive elements being conductive microspheres.

6. Apparatus according to either of the claims 1 and 2, the means for rigidifying the membrane incorporating at least one passive substrate.

7. Apparatus according to claim 6, the passive substrate being connected to one of the membrane and to the line by means of insulating anchoring elements.

8. Apparatus according to claim 7, the anchoring elements being plastic spheres.

9. Apparatus according to either of the claims 1 and 2, the means for rigidifying the membrane comprising anchoring elements contacting the substrate in which is formed the cavity, in an area located beyond the opening defined by the cavity on one of the sides of the substrate.

10. Apparatus for the propagation of ultrahigh frequency microwaves, comprising a substrate in which is formed a cavity open on one of the sides of the substrate, an insulating membrane deposited on the substrate and above the cavity, at least one transmission line located on the membrane above the cavity for propagating said ultrahigh frequency microwaves, and means for rigidifying the membrane, said means being fixed to the membrane on a lateral side from where the transmission line is located and fixed to the at least one transmission line.

11. Apparatus for the propagation of microwaves according to claim 10, the cavity being an electrically shielded cavity.

12. Apparatus for the propagation of microwaves according to claim 10, the means for rigidifying the membrane having at least one active circuit.

13. Apparatus according to claim 12, said at least one active circuit being connected to the membrane by conductive elements.

14. Apparatus according to claim 13, the conductive elements being conductive microspheres.

15. Apparatus according to claim 10, the means for rigidifying the membrane incorporating at least one passive substrate.

16. Apparatus according to claim 15, the passive substrate being connected to one of the membrane and the line by means of insulating anchoring elements.

17. Apparatus according to claim 16, the anchoring elements being plastic spheres.

18. Apparatus for the propagation of ultrahigh frequency microwaves, comprising a substrate in which is formed a cavity open on one of the sides of the substrate, an insulating membrane deposited on the substrate and above the cavity, at least one transmission line located on the membrane above the cavity for propagating said ultrahigh frequency microwaves, and means for rigidifying the membrane, said means being fixed by means of conductive or insulating anchoring elements to said substrate, in an area located beyond the opening defined by said cavity, and being fixed to at least that part of the membrane situated above the cavity.

19. Apparatus for the propagation of microwaves according to claim 18, the cavity being an electrically shielded cavity.

20. Apparatus for the propagation of microwaves according to claim 18, the means for rigidifying the membrane having at least one active circuit.

21. Apparatus according to claim 18, the means for rigidifying the membrane incorporating at least one passive substrate.

22. Apparatus according to claim 18, the anchoring elements being plastic spheres.

23. Apparatus for the propagation of ultrahigh frequency microwaves, comprising a substrate in which is formed a cavity open on one of the sides of the substrate, an insulating membrane deposited on the substrate and above the cavity, at least one transmission line located on the membrane above the cavity for propagating said ultrahigh frequency microwaves, and means for rigidifying the membrane, said means being fixed by means of conductive or insulating anchoring elements to said substrate, in an area located beyond the opening defined by said cavity, and being fixed to the at least one transmission line.

24. Apparatus for the propagation of microwaves according to claim 23, the cavity being an electrically shielded cavity.

25. Apparatus for the propagation of microwaves according to claim 23, the means for rigidifying the membrane having at least one active circuit.

26. Apparatus according to claim 23, the means for rigidifying the membrane incorporating at least one passive substrate.

27. Apparatus according to claim 23, the anchoring elements being plastic spheres.

* * * * *